US005874039A

United States Patent [19]

Edelson

[11] Patent Number: 5,874,039

[45] **Date of Patent: *Feb. 23, 1999**

[54] LOW WORK FUNCTION ELECTRODE

[75] Inventor: Jonathan Sidney Edelson, Multnomah County, Oreg.

[73] Assignee: Borealis Technical Limited, London, England

[ * ] Notice: The term of this patent shall not extend beyond the expiration date of Pat. No. 5,675,972.

[21] Appl. No.: 935,196

[22] Filed: Sep. 22, 1997

[51] Int. Cl.[6] ..... C25B 11/00; H01J 1/05

[52] U.S. Cl. ..... 204/290 R; 204/290 F; 313/310; 313/311; 313/498; 313/503; 313/504; 313/505

[58] Field of Search ..... 313/310, 311, 313/498, 503, 504, 505; 204/290 R, 290 F, 282, 403, 418; 427/77, 78

[56] References Cited

U.S. PATENT DOCUMENTS

| | | | |
|---|---|---|---|
| 4,484,989 | 11/1984 | Mansell | 204/296 |
| 5,128,587 | 7/1992 | Skotheim et al. | 313/498 |
| 5,675,972 | 10/1997 | Edelson | 313/310 |

*Primary Examiner*—Bruce F. Bell

[57] ABSTRACT

A substrate is coated with a compound comprised of a cation completed by a heterocyclic multidentate ligand, which provides a surface having a low work-function and facilitates the emission of electrons.

26 Claims, 3 Drawing Sheets

FIGURE 2
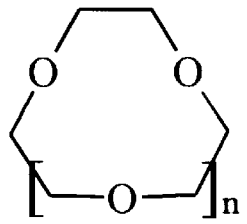
Figure 2a
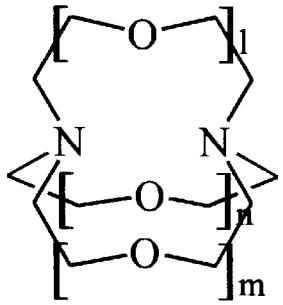
Figure 2b
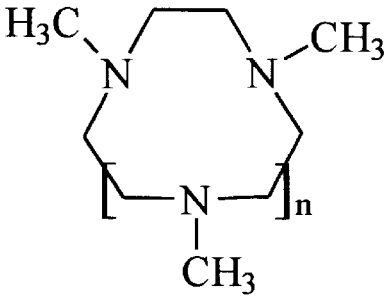
Figure 2c
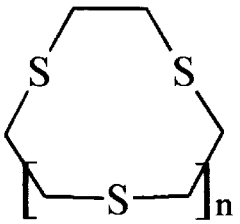
Figure 2e
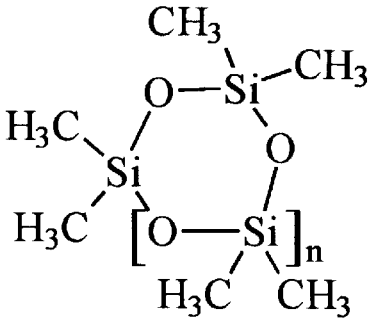
Figure 2d FIGURE 3
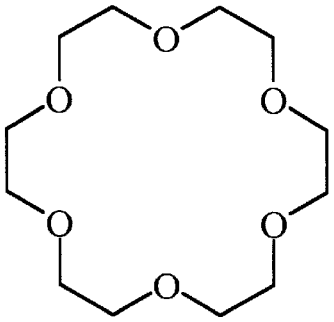
Figure 3a
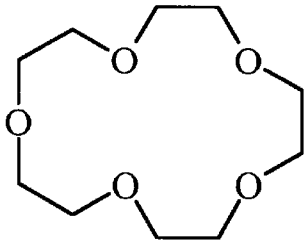
Figure 3b
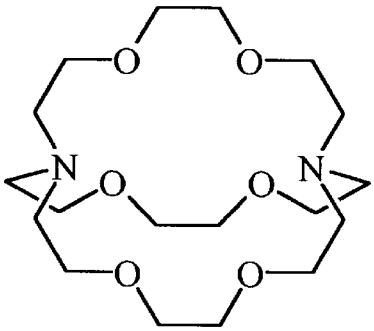
Figure 3c
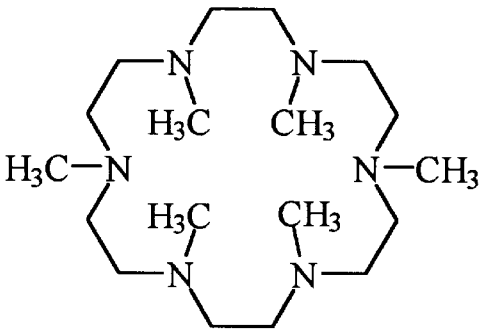
Figure 3d

LOW WORK FUNCTION ELECTRODE

BACKGROUND

1. Cross Reference to Related Applications

This invention is related to U.S. application Ser. No. 08/719,792, now U.S. Pat. No. 5,675,972, entitled "Method and Apparatus for Vacuum Diode-Based Devices with Electride-Coated Electrodes", filed 25$^{th}$ Sep. 1996, and U.S. application Ser. No. 08/744,574, now U.S. Pat. No. 5,810,980 entitled "Low Work Function Electrode", filed 6$^{th}$ Nov. 1996.

2. Field of Invention

The present invention relates to electrodes as used in vacuum electronic systems and structures enabling a current of electrons to flow between a metallic conductor and another body. It also relates to vacuum diode-based thermoelectric devices, and in particular to vacuum diode-based thermoelectric devices with electrodes having a low work function.

Electron Devices

Vacuum electronic devices employ a flow of electrons through a vacuum space between a cathode and an anode. Through manipulation of the voltages of intermediate electrodes, the use of magnetic fields, or other techniques, various desired end results may be achieved. For example, placing a grid like electrode between cathode and anode permits a small signal applied to said grid to greatly influence the flow of current from cathode to anode: this is the vacuum triode used for amplification. Operation of these devices depends upon the ability of the cathode to emit electrons into the vacuum.

Devices employing current flowing through a gas also require electrodes which easily emit electrons. Further, propulsion devices which operate on the principal of current flowing through diffuse plasmas in magnetic fields also depend heavily on the ability of electrodes to easily emit electrons.

Most such devices make use of the heated thermionic cathode. In such a cathode, a metal or oxide coated metal is heated until thermally excited electrons are capable of escaping from the metal. Such thermionic cathodes are capable of operation at current densities up to several hundreds of amperes per square centimeter. Such devices still find active use in high power devices such as are found in radio transmitters, however at the small scale the solid state transistor has virtually replaced the vacuum tube in all uses.

Vacuum Diode-Based Devices

In Edelson's disclosure, filed 1995 Mar. 7, titled "Electrostatic Heat Pump Device and Method", Ser. No. 08/401,038, now abandoned, two porous electrodes were separated by a porous insulating material to form an electrostatic heat pump. In said device, evaporation and ionization of a working fluid in an electric field provided the heat pumping capacity. The use of electrons as the working fluid is disclosed in that application. In Edelson's subsequent disclosure, filed 1995 Jul. 5, titled "Method and Apparatus for Vacuum Diode Heat Pump", Ser. No. 08/498,199, still pending, an improved device and method for the use of electrons as the working fluid in a heat pumping device is disclosed. In this invention, a vacuum diode is constructed using a low work function cathode.

In Edelson's further subsequent disclosure, filed 1995 Dec. 15, titled "Method and Apparatus for Improved Vacuum Diode Heat Pump", Ser. No. 08/573,074, now U.S. Pat. No. 5,722,242 and incorporated herein by reference in its entirety, the work function of the anode was specified as being lower than the work function of the cathode in order to optimize efficient operation.

In a yet further subsequent disclosure, filed 1995 Dec. 27, titled "Method and Apparatus for a Vacuum Diode Heat Pump With Thin Film Ablated Diamond Field Emission", Ser. No. 08/580,282, now abandoned, Cox and Edelson disclose an improvement to the Vacuum Diode Heat Pump, wherein a particular material and means of construction was disclosed to further improve upon previous methods and devices.

The Vacuum Diode at the heart of Edelson's Vacuum Diode Heat Pump may also be used as a thermionic generator: the differences between the two devices being that in the operation of the thermionic generator, the cathode is warmer than the anode, and heat flows from a warmer region to a cooler region. The thermionic generator is well known in the art.

In Cox's disclosure, filed 1996 Mar. 6, titled "Method and Apparatus for a Vacuum Thermionic Converter with Thin Film Carbonaceous Field Emission", Ser. No. 08/610,599, still pending and incorporated herein by reference in its entirety, a Vacuum Diode is constructed in which the electrodes of the Vacuum Diode are coated with a thin film of diamond-like carbonaceous material. A Vacuum Thermionic Converter is optimized for the most efficient generation of electricity by utilizing a cathode and anode of very low work function. The relationship of the work functions of cathode and anode are shown to be optimized when the cathode work function is the minimum value required to maintain current density saturation at the desired temperature, while the anode's work function is as low as possible, and in any case lower than the cathode's work function. When this relationship is obtained, the efficiency of the original device is improved.

In my recent disclosure, U.S. application Ser. No. 08/719,792, now U.S. Pat. No. 5,675,972 entitled "Method and Apparatus for Vacuum Diode-Based Devices with Electride-Coated Electrodes", filed 25$^{th}$ Sep. 1996, and incorporated herein by reference in its entirety, I describe vacuum diode based devices in which at least one of the electrodes comprises a compound composed of complexed alkali metal cations. In that disclosure I do not teach that complexed cations other than alkali metal cations may be used.

Work Function

A measure of the difficulty of the escape of an electron from an electrode is given by the work function. The work function is the amount of work needed to pull an electron from a bulk neutral material to the vacuum level, generally measured in electron volts. In a thermionic cathode, this work is supplied by the kinetic energy of the thermally excited electron; rapidly moving electrons are slowed down as they leave the metal, and most electrons do not have sufficient speed to escape and are thus pulled back. However a small fraction of the electrons have enough kinetic energy so as to be able to escape from the cathode.

The lower the work function of the electrode, the greater the number of electrons which will be capable of escaping from the cathode. If increased current density is not needed, then the lower work function will allow for operation at lower temperatures. Extremely low work function devices would allow the operation of vacuum electron devices at room temperature, without a heated cathode.

Low work function electrode technology, particularly cold cathode technology, is presently undergoing extensive development, with many articles being published and numerous patents being issued. Work in the art has been focused on the development of better emissive structures and materials, the use of such devices in electronic applications, and enhanced methods of fabricating such devices as well as fabricating integrated devices. In order to facilitate the flow of electrons from cathode to anode, surfaces of very low work functions must be constructed, and some alkalides and electrides have this property.

Electrides

Electrides are organo-metallic compounds comprised of an alkali metal cation, an alkaline earth metal cation, or a lanthanide metal cation, complexed by a multidentate cyclic, heterocyclic or poly-cyclic ligand. This ligand so stabilizes the cation that the electron may be considered free from the metal. In solution, electrides consist of the metal-ligand structure in solution as the cation, and free electrons in solution as the anion. Electrides form ionic crystals where the electrons act as the anionic species.

Ligands known to form electrides are cyclic or bicyclic polyethers or polyamines include the crown ethers, cryptands, and aza-crown ethers. Materials which are expected to form electrides include the thio analogs to the crown ethers and the cryptands, as well as the silicon analogs thereto.

Vacuum Diode-Based Devices with Electride-Coated Electrodes

In my previous disclosure, entitled "Low Work Function Electrode", and incorporated herein by reference in its entirety, I describe a low work function electrode comprising a metal coated with a layer of a heterocyclic multidentate ligand.

In that disclosure, I do not teach the use of a non-metallic electrode, or the use of a compound comprised of a cation completed by a heterocyclic multidentate ligand coated as a thin layer on a substrate.

BRIEF DESCRIPTION OF INVENTION

Broadly, the present invention consists of a substrate coated with a layer of a compound comprised of a cation complexed by a heterocyclic multidentate ligand, thereby providing a surface having a low work-function.

In a further embodiment, said compound is coated as a monolayer on the material surface.

OBJECTS AND ADVANTAGES

It is an object of the present invention to provide electrodes comprising a substrate coated with a layer of a compound comprised of a cation complexed by a heterocyclic multidentate ligand.

An advantage of the present invention is that said compound provides a surface having a low work function.

REFERENCE NUMERALS IN DRAWINGS

1 Substrate

2 Compound

DESCRIPTION OF DRAWINGS

FIG. 2(*a*)–(*e*) shows the general chemical structures of some heterocyclic multidentate ligands:

FIG. 2*a* is the general structure of crown ethers.

FIG. 2*b* is the general structure of cryptands.

FIG. 2*c* is the general structure of aza-crown ethers.

FIG. 2*d* is the general structure of silicone crown ethers.

FIG. 2*e* is the general structure of thio-crown ethers.

FIG. 3(*a*)–(*d*) shows the chemical structures of some known electride forming ligands.

FIG. 3*a* is the structure of 18-crown-6.

FIG. 3*b* is the structure of 15-crown-5.

FIG. 3*c* is the structure of cryptand [2.2.2].

FIG. 3*d* is the structure of hexamethyl hexacyclen.

DESCRIPTION OF INVENTION

Figure 1:
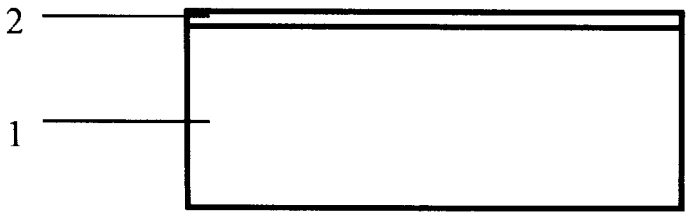
FIG. 1 shows diagrammatic representations of the low work-function electrode of the present invention.

Referring to FIG. 1, substrate 1 is coated with a layer of compound 2. Compound 2 is comprised of a cation complexed by a heterocyclic multidentate ligand. In one embodiment, compound 2 can be an electride. In another embodiment compound 2 can be an alkalide.

In a preferred embodiment, compound 2 is coated in a monolayer upon the surface of substrate 1.

Composition of Electrode 1

In a preferred embodiment, substrate 1 is composed of a transition metal, such as nickel. In another embodiment substrate 1 is an alkali metal, an alloy of metals, an alloy of alkali metals, or an alloy of transition metals.

In another embodiment substrate 1 is a non-metal, such as silicon or quartz. In a further embodiment substrate 1 is a polymeric material such as polycarbonate, polystyrene, polypropylene of polyethylene.

The alkali metals are lithium, sodium, potassium, rubidium, cesium, and francium. The alkali earth metals are beryllium, magnesium, calcium, strontium, barium, and radium. The lanthanide metals are lanthanum, cerium, praseodymium, neodymium, promethium, samarium, europium, gadolinium, terbium, dysprosium, holmium, erbium, thulium, ytterbium, lutetium, and hafnium. The actinide metals include actinium, thorium, protactinium, uranium, and the transuranic metals. The transition metals are scandium, titanium, vanadium, chromium, manganese, iron, cobalt, nickel, copper, zinc, yttrium, zirconium, niobium, molybdenum, technetium, ruthenium, rhodium, palladium, silver, cadmium, lutetium, hafnium, tantalum, tungsten, rhenium, osmium, iridium, platinum, gold, and mercury.

Complexing Heterocyclic Multidentate Ligands

Referring to FIG. 2 we see chemical structures for various classes of complexing ligands. FIG. 2*a* is the general structure of the crown-ethers. The crown-ether is a cyclic structure composed of repeated instances of $CH_2$—$CH_2$—O. The oxygen atoms make available non-bonding electron pairs which act to stabilize cations. FIG. 2*b* is the general structure of the cryptands. The general structure is a bicyclic poly-ether, composed of repeated instances of $CH_2$—$CH_2$—O, combined with nitrogen 'end-links' which allow for the addition of a third poly-ether chain. FIG. 2*c* is the general structure of the aza-crown-ethers. The aza-crown-ether, or cyclen, is a cyclic structure composed of repeated instances of $CH_2$—$CH_2$—NX, where X is $CH_3$. The nitrogen atoms each make available a single non-bonding electron pair to stabilize cations, while being more stable than the oxygen crown-ethers. FIG. 2*d* is a silicone analog to the crown-ethers, a cyclic structure composed of repeated instances of $Si(CH_3)_2$—O. FIG. 2*e* is the general structure of the thio-crown-ethers. The thio-crown-ether is a cyclic structure composed of repeated instances of $CH_2$—$CH_2$—S. The sulfur atoms make available non-bonding electron pairs which act to stabilize cations.

Referring to FIG. 3, we see specific examples of complexing ligands known to form electrides and alkalides. FIG. 3*a* is 18-Crown-6, also known by the IUPAC name 1,4,7,10,13,16-hexaoxacyclooctadecane. FIG. 3*b* is 15-Crown-5, also known by the IUPAC name 1,4,7,10,13-pentoxacyclopentadecane. FIG. 3*c* is Cryptand [2,2,2], also known by the IUPAC name 4,7,13,16,21,24-hexoxa-1,10-diazabicyclo [8,8,8] hexacosane. FIG. 3*d* is hexamethyl hexacyclen.

Preferred Embodiments

In a preferred embodiment, substrate 1 is composed of quartz. Layer of compound 2 is introduced by vacuum deposition. This process, which yields a thin film of compound 2 of controllable thickness and composition, involves placing the heterocyclic multidentate ligand and metal in separate containers under high vacuum. By manipulating the temperature of the containers, the metal and heterocyclic multidentate ligand are evaporated and deposited simultaneously onto a quartz surface at an adjustable rate. A solid state reaction between the heterocyclic multidentate ligand and metal produces the film of compound 2. In a further embodiment, compound 2 could be layered onto diamond or sapphire by vapor deposition in a similar manner.

In another embodiment, a metal substrate 1, preferably a silver substrate, is treated with a modified crown ether having thiol functionalities which allow it to be immobilized to the silver surface. Gas phase or solution techniques may then be used to complex cations into the immobilized crown ethers, thereby forming a layer of compound 2 on substrate 1.

In another particularly preferred embodiment, substrate 1 is composed of nickel. Layer of compound 2 is composed of 15-Crown-5 or 18-Crown-6 and a metal cation in a monolayer, produced by gas phase or solution techniques.

In yet another particularly preferred embodiment, substrate 1 is composed of nickel. Layer of compound 2 is composed of hexamethyl hexacyclen, known by the IUPAC name 1,4,7,10,13,16-hexaaza-1,4,7,10,13,16-hexamethyl cyclooctadecane, and a metal cation in a monolayer, produced by gas phase or solution techniques.

SUMMARY, RAMIFICATION, AND SCOPE

The essence of the present invention is the use of a compound comprised of a cation complexed by a heterocyclic multidentate ligand coated on a substrate to provide electrodes with a low work-function.

Specific materials and ligands have been described, however other materials may be considered, as well as other ligands. Metal cations have been specified, but other cations such as ammonium or substituted ammonium, may be used.

Although the above specification contains many specificities, these should not be construed as limiting the scope of the invention but as merely providing illustrations of some of the presently preferred embodiments of this invention. For example, no specification has been given for surface morphology. While the specification is for a layer of ligand upon a surface, this surface may be flat, formed into a shape suitable for a particular application, microstructured to enhance emission using field emission techniques, microstructured to increase surface area, or otherwise altered in physical configuration.

No specification has been given for electrode size. While large area electrodes such as are used in conventional vacuum tubes, thermionic converters, and the like are facilitated by the present invention, microfabricated vacuum electronic devices are also possible. The present invention may be used to facilitate the production of flat panel displays, integrated vacuum microcircuits, or vacuum microelectronic mechanical systems.

Thus the scope of the invention should be determined by the appended claims and their legal equivalents, rather than by the examples given.

I claim:

1. A low work function electrode, comprising a substrate coated with a thin layer of a compound comprising cations completed by a heterocyclic multidentate ligand coated upon said substrate.

2. The low work function electrode of claim 1 wherein said layer of a compound is a monolayer.

3. The low work function electrode of claim 1 wherein said layer of a compound is substantially a single molecular layer.

4. The low work function electrode of claim 1 wherein said cation is a cationic form of a metal.

5. The low work function electrode of claim 1 wherein said cation is a cationic form of a metal chosen from the group consisting of alkali metals, alkaline earth metals, lanthanides, and actinides.

6. The low work function electrode of claim 1 wherein said cation is a cationic form of a transition metal.

7. The low work function electrode of claim 1 wherein said heterocyclic multidentate ligand is chosen from the group consisting of crown-ethers, cryptands, aza-crown-ethers, cyclic-silicones, and thio-crown-ethers.

8. The low work function electrode of claim 1 wherein said heterocyclic multidentate ligand is chosen from the group consisting of 15-Crown-5, 18-Crown-6, Cryptand [2.2.2] and hexamethyl hexacyclen.

9. The low work function electrode of claim 1 wherein said substrate is composed of a material selected from the group consisting of quartz, glass, silicon, silica sapphire and diamond.

10. The low work function electrode of claim 1 wherein said substrate is composed of a material selected from the group consisting of polycarbonate, polystyrene, polypropylene and polyethylene.

11. The low work function electrode of claim 1 wherein said compound is an electride or alkalide.

12. A vacuum thermionic device selected from the group consisting of vacuum diode heat pumps, vacuum diode thermionic converters, photoelectric converters, vacuum electronic devices, flat panel displays, integrated vacuum microcircuits, and vacuum microelectronic mechanical systems, in which an electrode comprising a substrate coated with a thin layer of a compound comprising cations complexed by a heterocyclic multidentate ligand coated upon said substrate forms part of said vacuum thermionic device.

13. The vacuum thermionic device of claim 12 wherein said cation is a cationic form of a metal.

14. The vacuum thermionic device of claim 12 wherein said cation is a cationic form of a metal chosen from the group consisting of alkali metals, alkaline earth metals, lanthanides, and actinides.

15. The vacuum thermionic device of claim 12 wherein said cation is a cationic form of a transition metal.

16. The vacuum thermionic device of claim 12 wherein said heterocyclic multidentate ligand is chosen from the group consisting of crown-ethers, cryptands, aza-crown-ethers, cyclic-silicones, and thio-crown-ethers.

17. The vacuum thermionic device of claim 12 wherein said heterocyclic multidentate ligand is chosen from the group consisting of 15-Crown-5, 18-Crown-6, Cryptand [2.2.2] and hexamethyl hexacyclen.

18. The vacuum thermionic device of claim 12 wherein said layer of a compound is a monolayer.

19. The vacuum thermionic device of claim 12 wherein said substrate is composed of a material selected from the group consisting of quartz, glass, silicon, silica sapphire and diamond.

20. The vacuum thermionic device of claim 12 wherein said substrate is composed of a material selected from the group consisting of polycarbonate, polystyrene, polypropylene and polyethylene.

21. The vacuum thermionic device of claim 12 wherein said compound is an electride or alkalide.

22. A method for making a low work function electrode comprising the steps of:

a) providing a substrate, b) forming a layer of a heterocyclic multidentate ligand on the surface of said substrate, c) providing a source of cations, d) causing said cations to be complexed by said layer of a heterocyclic multidentate ligand.

23. The method of claim 22 in which the step of forming said layer of ligand comprises the step of: depositing said layer by vacuum deposition means.

24. The method of claim 22 in which the step of forming said layer of ligand comprises the step of: depositing said layer by solution deposition means.

25. The method of claim 22 in which said source of cations is a metal, an alloy or a non-metal.

26. The method of claim 22 in which the step of causing said cations to be complexed by said ligand comprises reacting said cations and said ligand, said reaction occurring in a solid state.

* * * * *

UNITED STATES PATENT AND TRADEMARK OFFICE

CERTIFICATE OF CORRECTION

PATENT NO : 5,874,039

DATED : Feb. 23, 1999

INVENTOR(S) : Jonathan Sidney Edelson

It is certified that error appears in the above-identified patent and that said Letters Patent is hereby corrected as shown below:

Column 6, line 20, change "completed" to --complexed--.

Signed and Sealed this

Twenty-first Day of September, 1999

*Attest:*

Q. TODD DICKINSON

*Attesting Officer*

*Acting Commissioner of Patents and Trademarks*